US005762037A

United States Patent [19]

Rothrock

[11] Patent Number: 5,762,037

[45] Date of Patent: Jun. 9, 1998

[54] FOOT LEVER ACTUATOR FOR PULL CORD ENGINE STARTERS

[76] Inventor: Leeman R. Rothrock, 8316 N. Lombard St., No. 444, Portland, Oreg. 97203

[21] Appl. No.: 813,260

[22] Filed: Mar. 7, 1997

[51] Int. Cl.[6] ..... F02N 3/04

[52] U.S. Cl. ..... 123/185.4

[58] Field of Search ..... 123/185.4, 185.3, 123/185.2

[56] References Cited

U.S. PATENT DOCUMENTS

| | | | |
|---|---|---|---|
| 3,018,768 | 1/1962 | Thompson | 123/185.4 |
| 3,626,937 | 12/1971 | Gjovik | 123/185.4 |
| 4,257,367 | 3/1981 | Fujikawa et al. | 123/185.4 |
| 4,397,274 | 8/1983 | Tarnedde | 123/185.4 |
| 5,253,540 | 10/1993 | Sanders et al. | 123/185.4 |

*Primary Examiner*—Andrew M. Dolinar
*Attorney, Agent, or Firm*—Olson & Olson

[57] ABSTRACT

A foot lever actuator for the pull cord recoil starter of a gasoline or diesel engine includes an elongated foot lever attached pivotally at one end to the framework supporting the engine and fitted at the opposite end with a foot pedal for pivoting the lever. An intermediate portion of the pull cord of the recoil starter is received over a bight pulley which is movable with the foot lever. In one embodiment, the bight pulley is connected directly to the foot lever at adjustable positions along the length of the foot lever. In another embodiment, the bight pulley is connected to a second pull cord received over a second bight pulley connected to the foot lever.

8 Claims, 6 Drawing Sheets

FOOT LEVER ACTUATOR FOR PULL CORD ENGINE STARTERS

BACKGROUND OF THE INVENTION

This invention relates to pull cord type engine starters, and more particularly to a foot lever pull cord actuator to replace the hand operation of a pull cord.

Small gasoline engines typically utilized for power lawnmowers, edgers, tillers and the like are started either by an electric starter or by a less expensive hand operated pull cord for operating a recoil type starter. Hand operation is not feasible for many individuals because of physical limitations of strength. Efforts to replace the hand operation with a foot operated system heretofore has not been completely satisfactory, because they have not afforded adjustment of the degree of force required of different persons of different strength capabilities, and have not accommodated pull cords of various lengths. Representative of these systems are those disclosed in U.S. Pat Nos. D330,557; 5,133,312; 5,070,828; 4,397,274; 3,381,677; and 3,018,768.

SUMMARY OF THE INVENTION

In its basic concept, this invention provides a foot lever actuator system for pull cord engine starters, in which a foot lever is mounted pivotally on an engine support and a pull cord extending from the recoil starter of the engine is operatively connected adjustably to the foot lever through a bight pulley.

It is the principal objective of this invention to provide a foot lever actuator system for a pull cord engine starter which overcomes the aforementioned limitations and disadvantages of prior foot lever systems.

Another objective of this invention is the provision of a foot lever actuator system of the class described that affords adjustment of the leverage and hence the leg force required to pull the recoil starter cord.

Still another objective of this invention is to provide a foot lever actuator system of the class described that affords adjustment of the length of pull of a pull cord to accommodate a wide range of recoil starter characteristics.

A further objective of this invention is the provision of a foot lever actuator system of the class described that accommodates use with a wide variety of implements that are powered by gasoline or diesel engines with pull cord recoil starters.

Another objective of this invention is the provision of a foot lever actuated system of the class described in which the foot lever is located at a position remote from the engine starter.

A still further objective of this invention is to provide a foot lever actuator system of the class described that is of simplified construction for economical manufacture, assembly, maintenance and repair.

The foregoing and other objects and advantages of this invention will appear from the following detailed description, taken in connection with the accompanying drawings of preferred embodiments.

DESCRIPTION OF THE PREFERRED EMBODIMENTS

Figure 1:
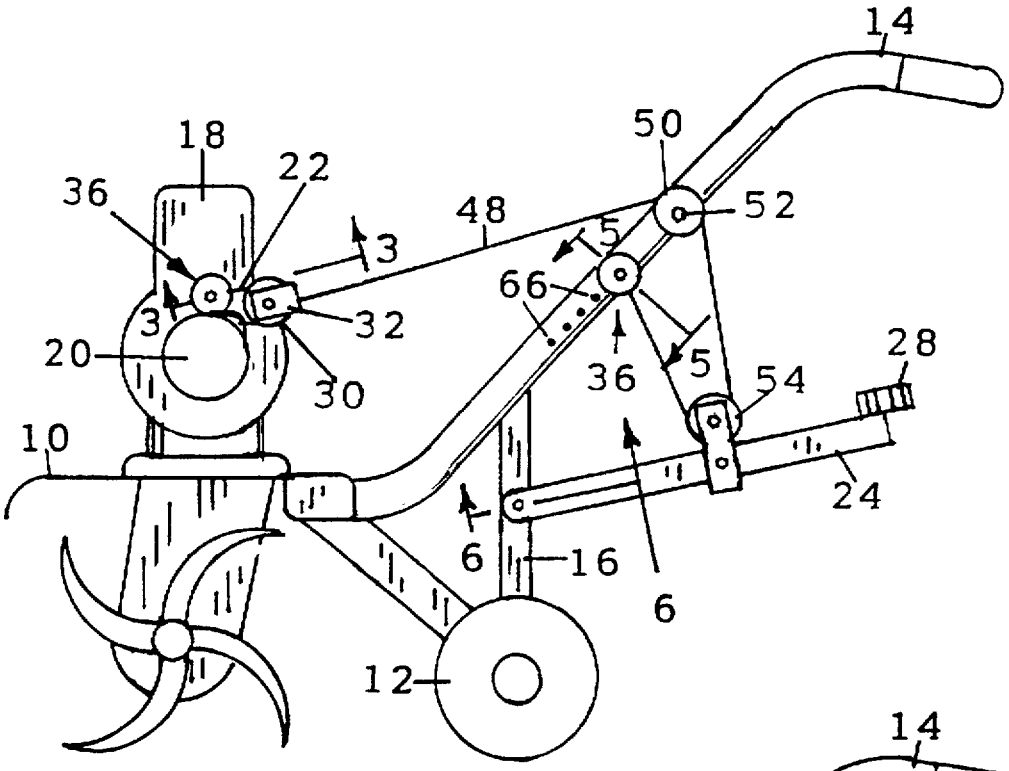
FIG. 1 is a schematic side elevational representation of a gasoline engine powered garden tiller having mounted thereon a foot lever pull cord actuator embodying the features of this invention, the foot lever being shown in the raised position in readiness to be depressed for pulling the pull cord to start the engine.

Referring first to the embodiment illustrated in FIGS. 16, there is shown schematically a conventional garden tiller framework 10 supported on wheels 12 and manipulated by handlebar 14. A reinforcing bracket 16 interconnects the wheel support and handlebar. The tiller is powered by gasoline engine 18 which is activated by a recoil starter 20 and pull cord 22, normally operated by hand and arm power.

In accordance with this invention, hand operation of the pull cord is replaced by less strenuous leg power. To this end, there is provided a foot lever 24 secured at one end pivotally to the tiller framework bracket 16 by pivot bolt 26. The other, outer end of the foot lever is provided with a foot pedal 28 upon which the foot is placed in preparation for applying leg power to the foot lever.

Figure 3:
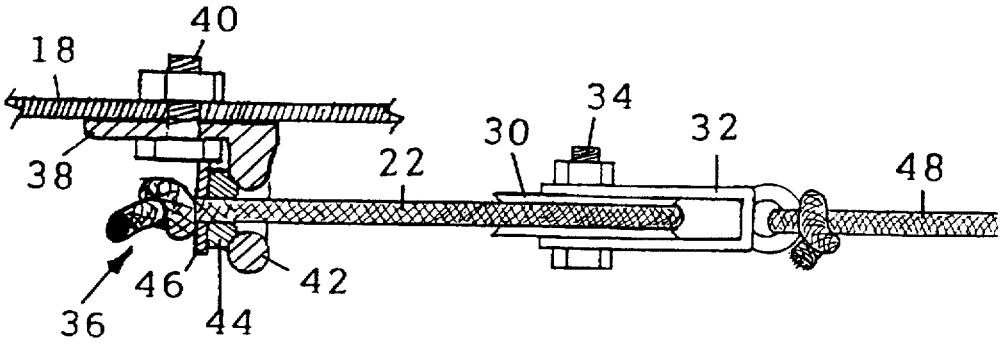
FIG. 3 is a fragmentary sectional view, on an enlarged scale, taken on the line 3—3 in FIG. 1.

A bight pulley 30 is mounted for rotation on a U-shaped support 32 by pivot bolt 34 (FIG. 3). The pull cord 22 is received over the pulley 30 and its free end is secured to the tiller engine by anchor 36. As best shown in FIG. 3, the anchor comprises a plate 38 provided with a central hole for reception of anchor bolt 40 which anchors the plate to the housing of engine 18. An eyelet 42 projects outwardly from the plate 38 and receives therethrough the outer end of pull cord 22. The pull cord also extends through a resilient O-ring 44 and washer 46, and then is tied into a knot, for securing the pull cord 22.

Figure 4:
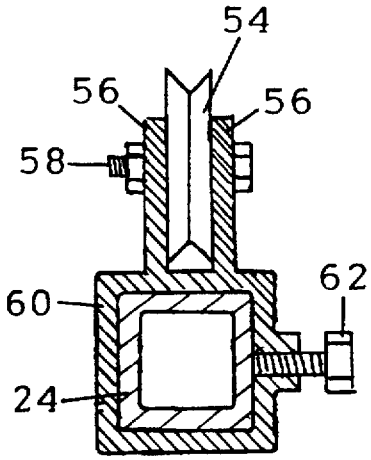
FIG. 4 is a sectional view, on an enlarged scale, taken on the line 4–4 in FIG. 2.
Figure 6:
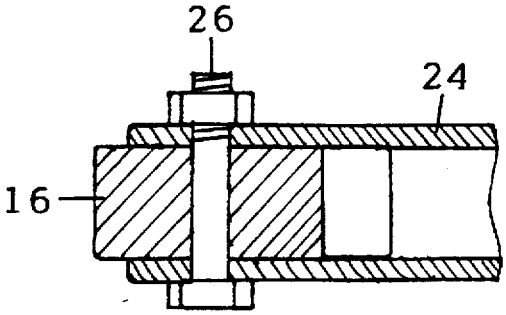
FIG. 6 is a fragmentary sectional view, on an enlarged scale, taken on the line 6–6 in FIG. 1.

A second pull cord 48 is attached, as by a knot, at one end to the support 32 and is received over directional pulley 50 (FIG. 1) mounted on the handlebar 14 by pivot bolt 52. The pull cord 48 is received over a second bight pulley 54 mounted between the lugs 56 (FIG. 4) by pivot bolt 58. The lugs extend from a support sleeve 60 configured for slidable mounting on the foot lever 24. Position of the sleeve along the length of the foot lever is secured by clamp screw 62.

Figure 5:
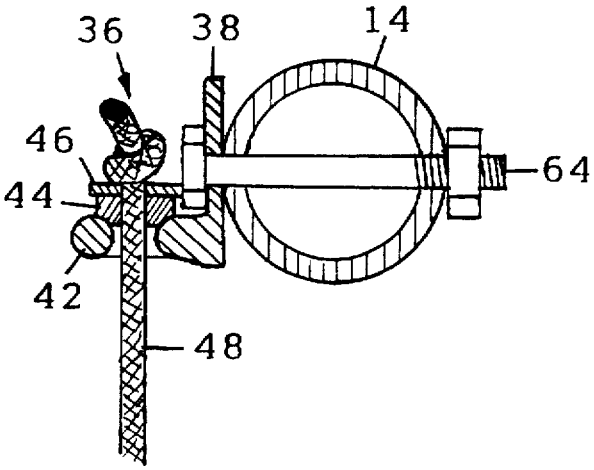
FIG. 5 is a fragmentary sectional view, on an enlarged scale, taken on the line 5–5 in FIG. 2.

The second pull cord 48 extends from the second bight pulley 54 to an anchor 36 on the handlebar 14. As best shown in FIG. 5, the anchor is the same as previously described and the central hole in the plate 38 receives anchor bolt 64. The bolt extends through any one of the plurality of holes 66 spaced apart along the length of the handlebar 14, by which to vary the distance between the anchor 36 and second bight pulley 54, and hence the length of second pull cord 48 therebetween.

Figure 2:
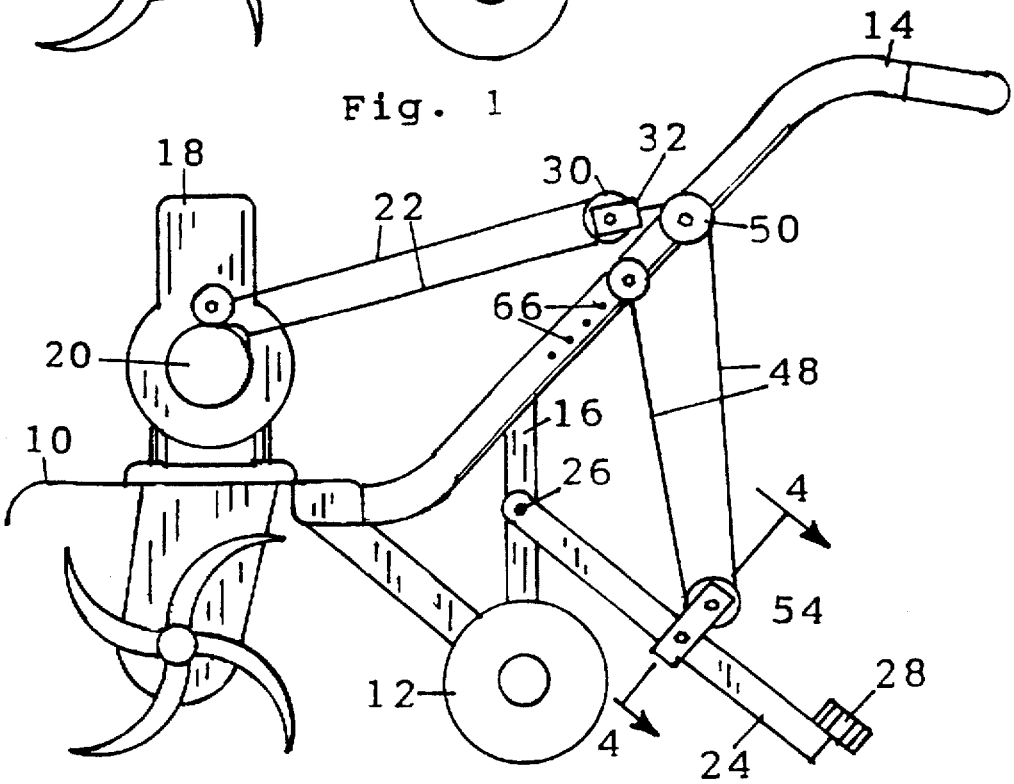
FIG. 2 is a schematic side elevation as in FIG. 1, showing the foot lever depressed, with consequent pulling of the pull cord for starting the engine.

FIG. 1 shows the pull cord and foot lever system in retracted position. To start the engine, an operator places a foot on the pedal 28 and, while grasping the handlebar 14 for stable support, presses downward with leg and body weight power, to pivot the foot lever 24 clockwise to the position of FIG. 2. This movement of the foot lever extends the second pull cord 48 between the now more widely spaced second bight pulley 54 and the anchor 36 and directional pulley 50, with corresponding rearward retraction of the bight pulley 30 and recoil starter pull cord 22. Upon starting of the engine, the operator removes his foot from the pedal 28, whereupon the recoil spring mechanism retracts the pull cord 22 and raises the foot lever 24 back to the position of FIG. 1. In some installations, a return spring may be employed to assist overcoming the weight of foot lever. For example, a coil spring may encircle the pivot bolt 26 and engage the bracket 16 and foot lever 24.

Figure 7:
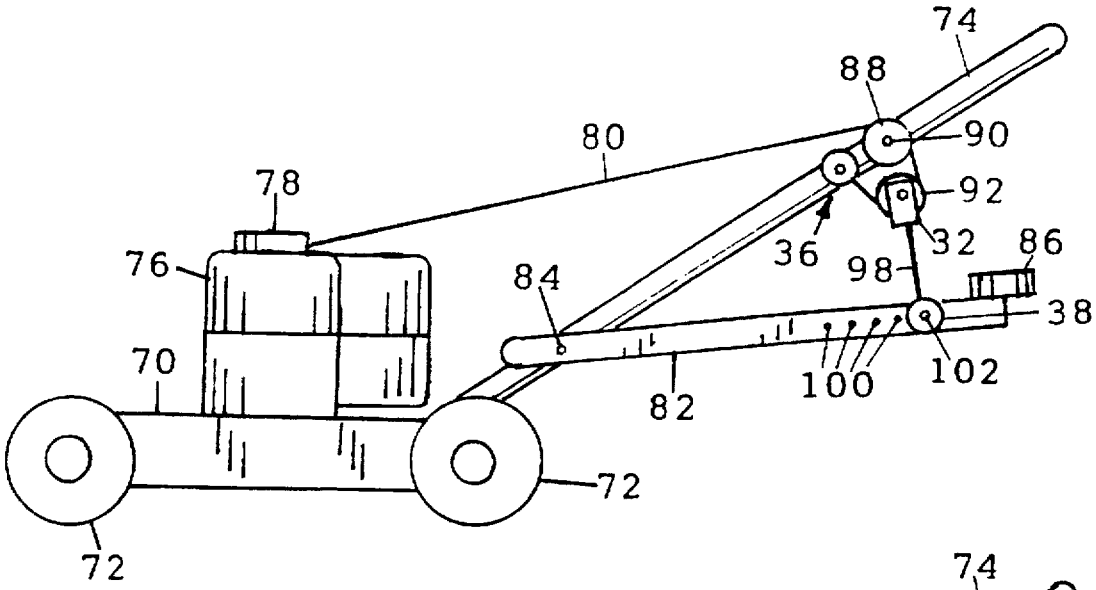
FIG. 7 is a schematic side elevational representation of a gasoline engine powered lawnmower having mounted thereon a foot lever actuator embodying the features of this invention, the foot lever being shown in the raised position in readiness to be depressed for pulling the pull cord to start the engine.
Figure 8:
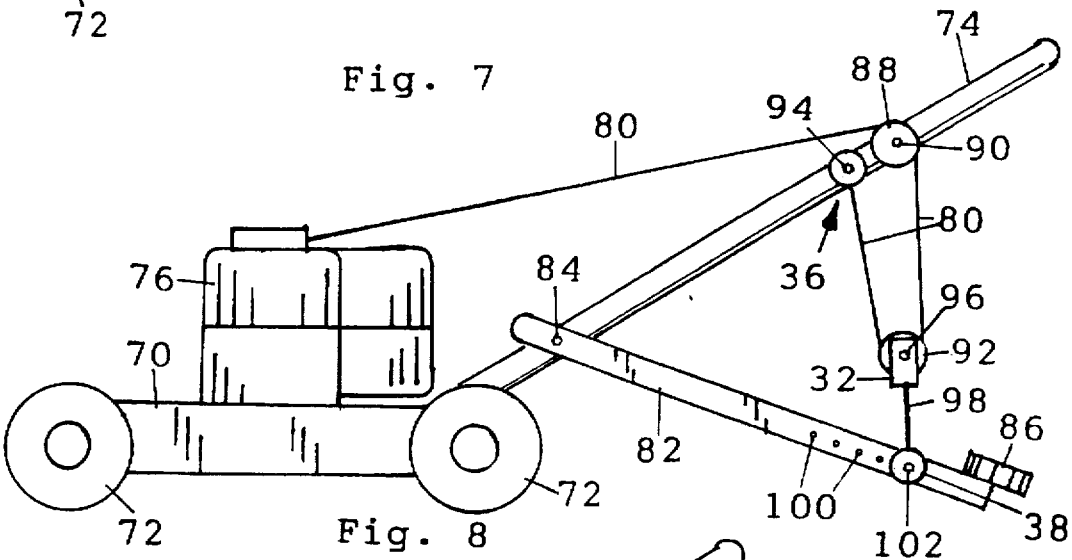
FIG. 8 is a schematic side elevation as in FIG. 7, showing the foot lever depressed, with consequent pulling of the pull cord for starting the engine.
Figure 9:
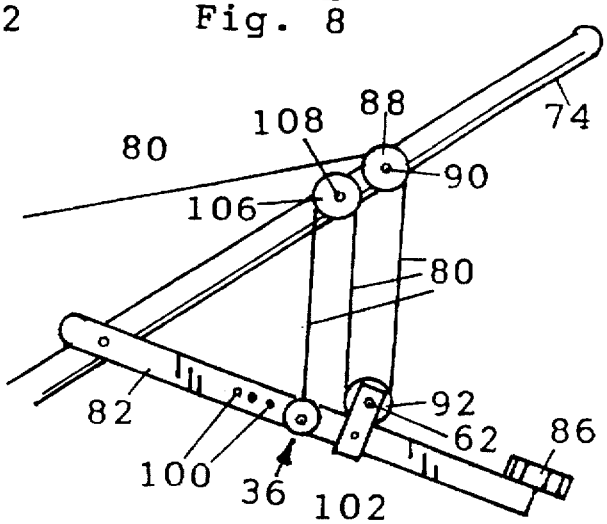
FIG. 9 is a fragmentary schematic side elevation, similar to FIG. 7, showing the use of two bight pulleys to reduce the arcuate movement of the foot lever for the same length of pull of the pull cord.

The embodiment of FIGS. 7–9 illustrates a lawnmower framework 70 mounted on wheels 72 and manipulated by handlebar 74. The mower is powered by gasoline engine 76 which is activated by recoil starter 78 and pull cord 80.

Foot lever 82 is mounted at one end on handlebar 74 by pivot bolt 84 and is provided at the opposite end with a foot pedal 86. The pull cord 80 extends from the recoil starter rearwardly over directional pulley 88 mounted on the handlebar by pivot bolt 90. The pull cord extends from directional pulley 88 over bight pulley 92 and is secured at its free end to the handlebar by anchor 36 secured to handlebar 14 by bolt 94. Anchor 36 preferably is the same type as previously described.

The bight pulley 92 is mounted for rotation on a U-shaped support 32 of the type described hereinbefore. Pivot bolt 96 mounts the bight pulley for rotation. Anchor strut 98 is secured at one end to the support 32 and at the opposite end to foot lever 82. Strut 98 preferably is a rigid member rigidly anchored to prevent its rotation about its longitudinal axis, to avoid twisting of pull cord 80. A plurality of holes 100 spaced apart along the foot lever allows selection of attachment of the anchor bolt 102 and hence adjustment of the distance between the bight pulley 92 and the directional pulley 88 and anchor bolt 94.

If desired, the anchor bolt 94 may be replaced with a second bight pulley 106 (FIG. 9) mounted on pivot bolt 108, and the free end of the pull cord 80 is secured adjustably at one of the plurality of holes 100 by anchor bolt 102. This arrangement allows full length travel of the pull cord 80 with less arcuate travel of the foot lever 82. The strut 98, bolt 102 and holes 100 may be replaced by an attachment like that shown in FIG. 4, to secure the bight pulley 92 adjustably to the foot lever 82.

Figure 10:
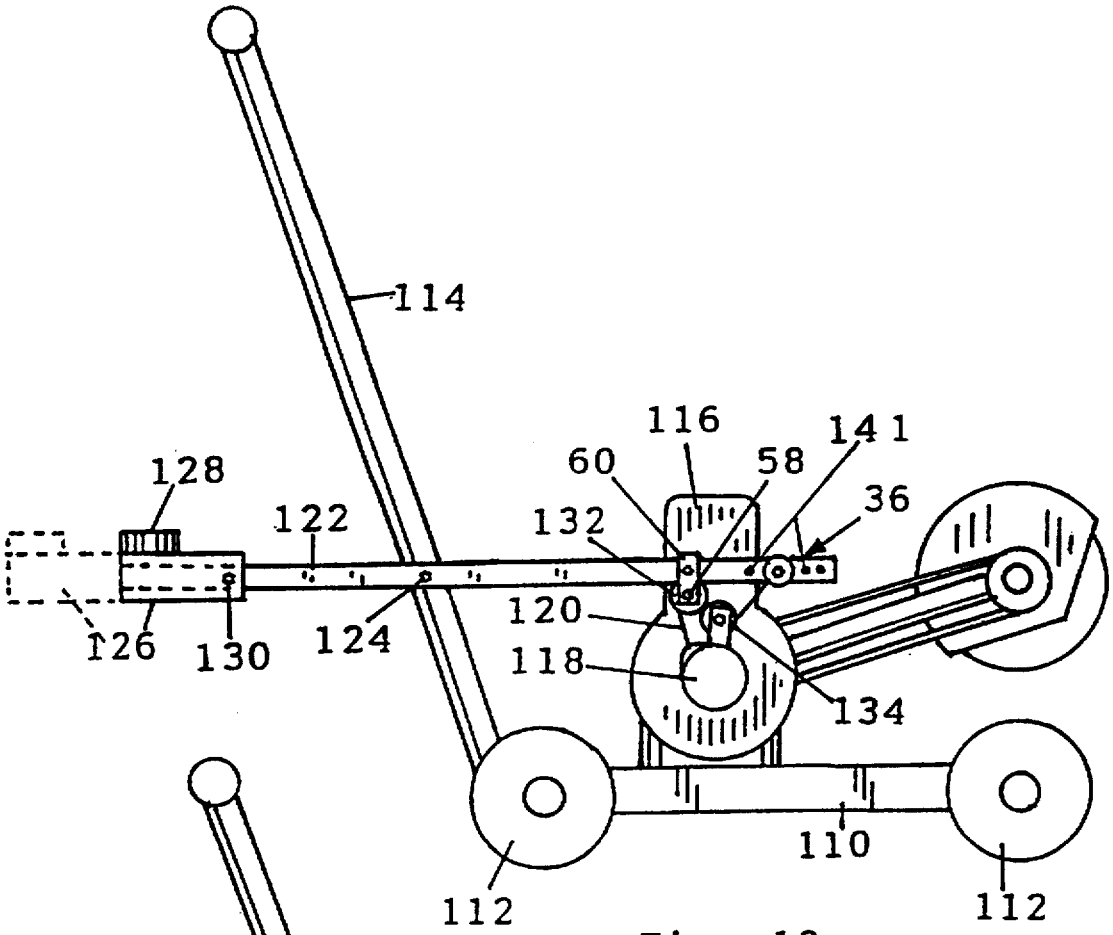
FIG. 10 is a schematic side elevation representation of a gasoline engine powered lawn edger having mounted thereon a foot lever actuator embodying the features of this invention, the foot lever being shown in the raised position in readiness to be depressed for pulling the pull cord to start the engine.
Figure 11:
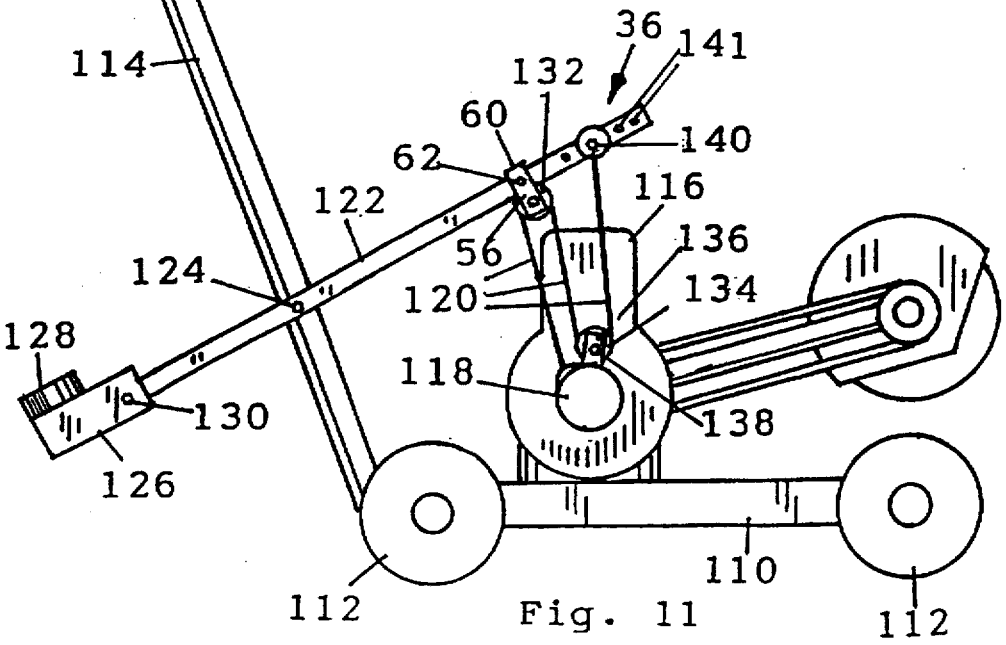
FIG. 11 is a schematic side elevation as in FIG. 10, showing the foot lever depressed, with consequent pulling of the pull cord for starting the engine.

FIGS. 10 and 11 illustrate an embodiment of the invention provided on a powered lawn edger framework 110. The framework is mounted on wheels 112 and is manipulated by handlebar 114. Gasoline engine 116 powers the edger and is activated by recoil starter 118 and pull cord 120.

Foot lever 122 is mounted pivotally, intermediate its ends, on the handlebar 114 by pivot bolt 124. The outer end of the foot lever is provided with an extension 126 which mounts a foot pedal 128 and is secured to the foot lever in selected positions of extension, by clamp screw 130.

The pull cord 120 extends from the recoil starter over a bight pulley 132 secured adjustably to the foot lever 122 in optimum position for receiving the pull cord from the recoil starter 118. Thus, the pulley is mounted between lugs 56 on pivot bolt 58, the lugs extending from support sleeve 60 secured to the foot lever by clamp screw 62.

The pull cord 120 then extends over second bight pulley 134 mounted on U-shaped bracket 136 by pivot bolt 138. The bracket 136 is secured to the recoil starter housing in any suitable manner, as by an anchor screw. The free end of the pull cord 120 is secured adjustably to the foot lever adjacent the end opposite the foot pedal, as by means of an anchor 36 of the type described hereinbefore and secured by bolt 140 received in a selected one of the plurality of mounting holes 141.

Figure 12:
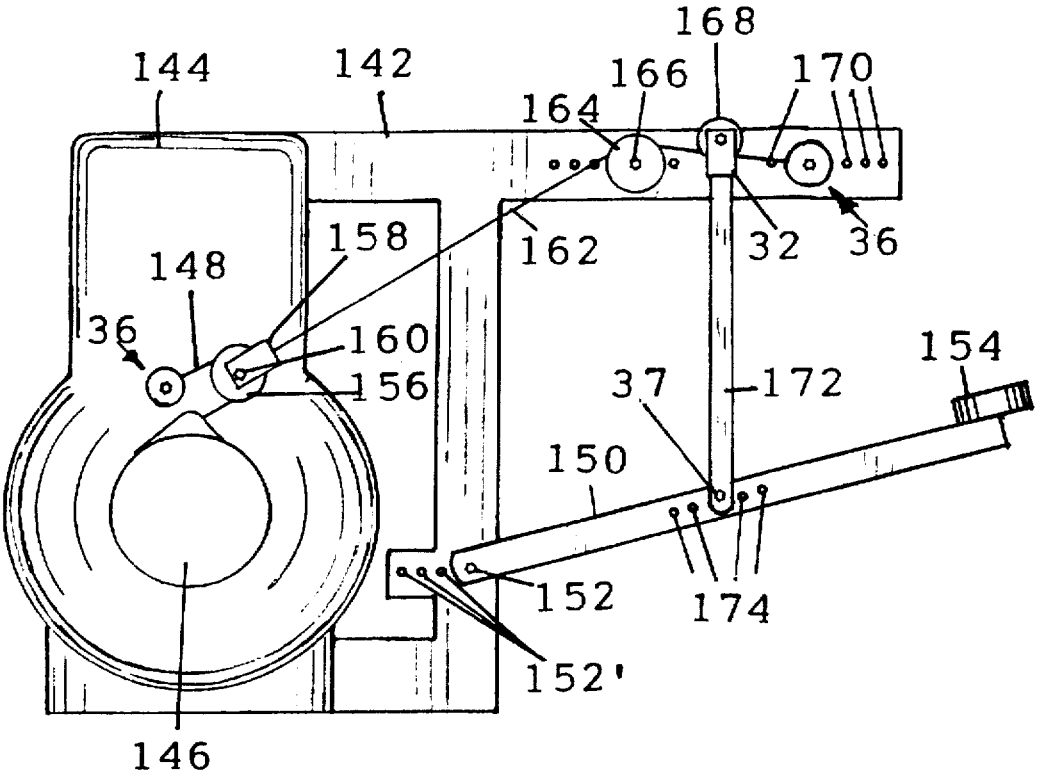
FIG. 12 is a schematic side elevational representation of a gasoline engine powered electric generator having mounted thereon a foot lever actuator embodying the features of this invention, the foot lever being shown in the raised position in readiness to be depressed for pulling the pull cord to start the engine.
Figure 13:
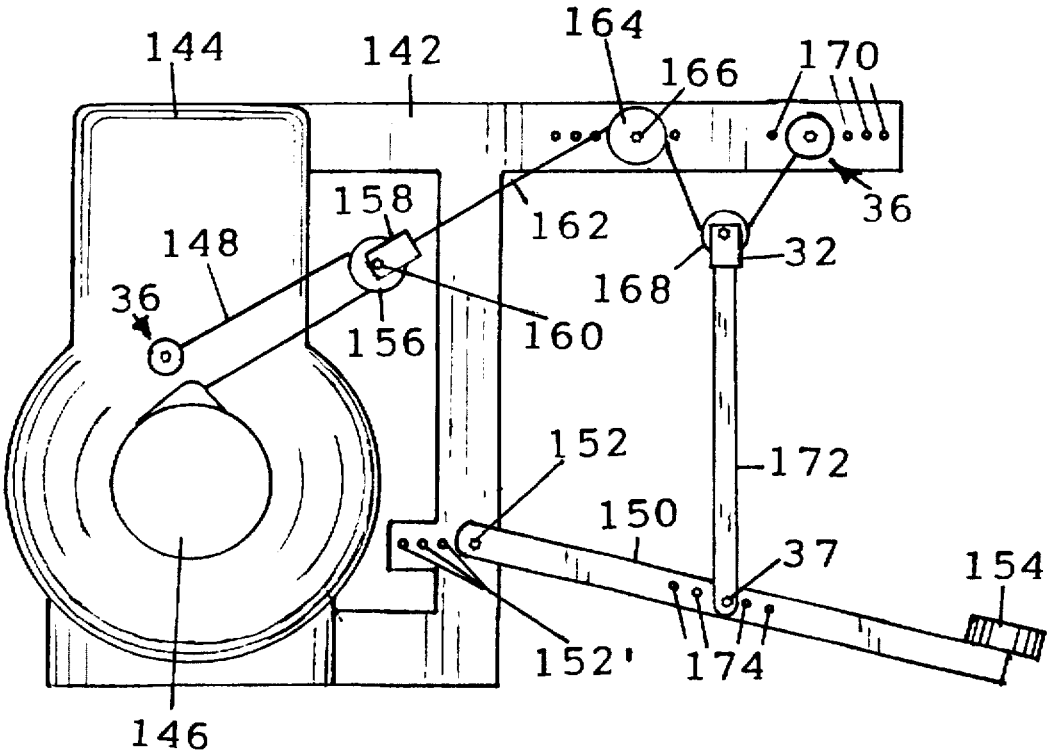
FIG. 13 is a schematic side elevation as in FIG. 12, showing the foot lever depressed, with consequent pulling of the pull cord for starting the engine.

In FIGS. 12 and 13, this invention is shown in association with the framework 142 of an auxiliary portable electric generator. The generator is driven by a gasoline or diesel engine 144 provided with a recoil starter 146 and pull cord 148. The foot lever 150 is mounted pivotally at one end on the framework by pivot bolt 152 in any one of the spaced holes 152' in an extension of frame 142. A foot pedal 154 is provided on the outer end of the foot lever.

The pull cord is received over bight pulley 156 and its free end is secured to the engine by an anchor 36 of the type previously described. The bight pulley is mounted on a U-shaped support 158 by pivot bolt 160, similar to support 32 and pivot bolt 34 described previously. A second pull cord 162 is secured at one end to the support 156 and extends over directional pulley 164 mounted on the framework 142 by pivot bolt 166. The pull cord 162 then extends over second bight pulley 168 and thence to anchor 36 mounted adjustably on the framework 142 at any one of the spaced holes 170. The bight pulley 168 is mounted rotatably on U-shaped support 32 which is anchored by strut 172 adjustably to the foot lever 150 by anchor bolt 37 at any one of the spaced holes 174.

Figure 14:
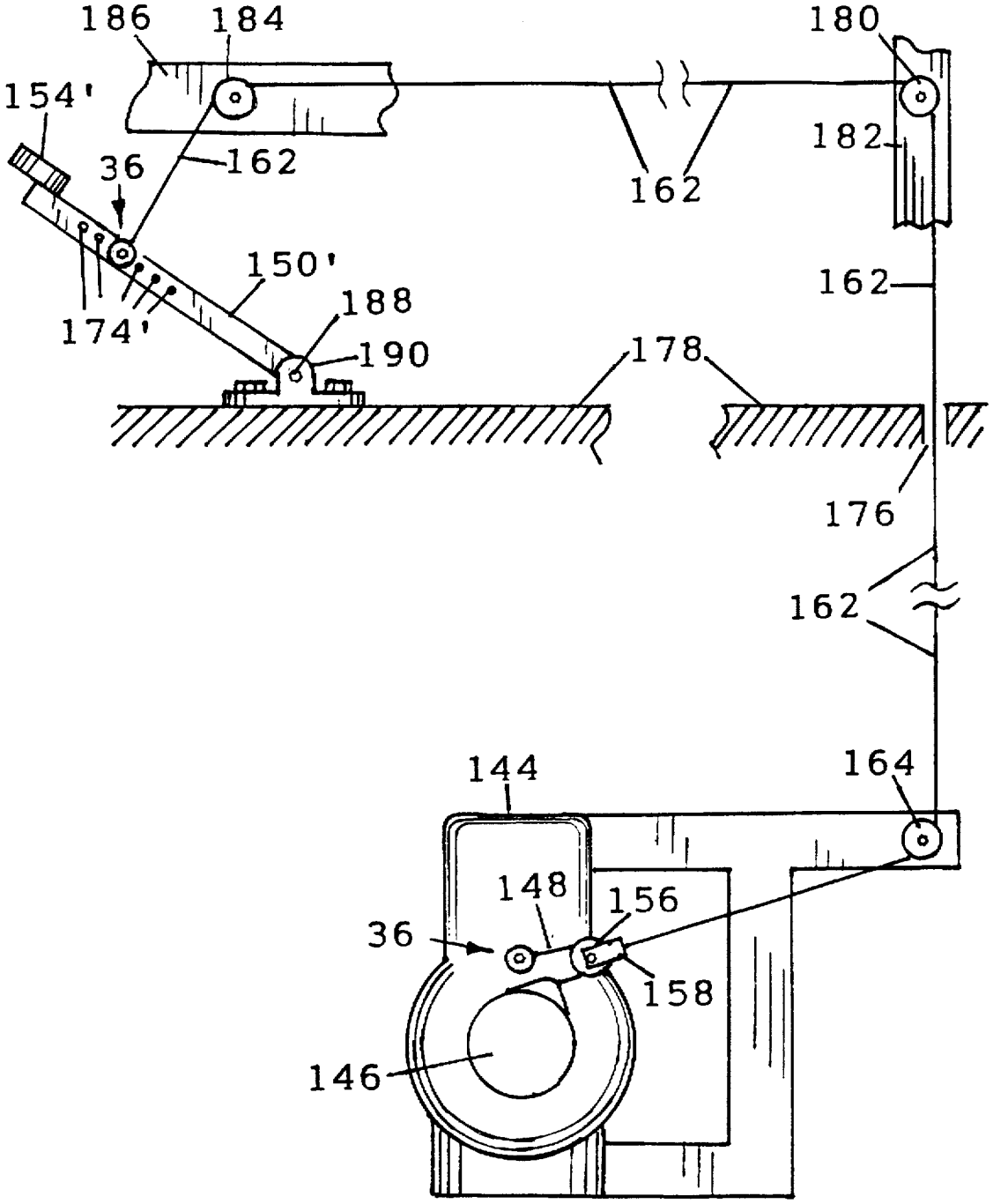
FIG. 14 is a foreshortened schematic side elevational representation of a gasoline engine powered electric generator similar to FIGS. 12 and 13 with the pull cord actuated from a remote position.

FIG. 14 illustrates an arrangement for actuating the pull cord 162 of FIGS. 12 and 13 from a position remote from the engine 144. Thus, the pull cord 162 extends over directional pulley 164 and then extends upwardly through an opening 176 in the floor 178 of a level above the engine. The pull cord then extends over a second direction pulley 180 mounted on a support 182 that is fixed relative to the engine 144. A third directional pulley 184 on a fixed support 186 in the said level receives the pull cord 162 and directs it to anchor 36 secured to foot lever 1501 at any one of the spaced holes 174'. The foot lever is secured pivotally to pivot bolt 188 mounted in anchor 190 secured to the floor 182.

It is to be noted that each of the embodiments described hereinbefore includes at least one bight pulley associated with the pull cord of the recoil starter. The pulley is connected adjustably to the foot lever to allow optimum extension of the pull cord, to insure effective starting of the engine, while optimizing the arcuate distance of travel of the foot lever, enabling the user to take advantage of his or her own weight to develop the power required to pull the recoil starter pull cord. Adjustment of the anchor positions of pull cords on the foot lever or implement framework, allows for adjusting the range of movement of the foot lever to the length of extension of pull cords associated with a variety of recoil starters.

From the foregoing, it will be appreciated that this invention provides simplified and economical mechanism by which to effect operation of a recoil starter pull cord by a minimum of leg power. The systems described are readily substituted for conventional hand-operated pull cords, much to the advantage for those individuals who lack the strength required for hand operation.

It will be apparent to those skilled in the art that various changes may be made in the size, shape, type, number and arrangement of parts described hereinbefore. For example, various other forms of anchors, pulley mounts and adjustment components may replace those described. These and other changes may be made without departing from the spirit of this invention and the scope of the appended claims.

I claim:

1. In combination with an implement powered by an engine having a recoil starter operated by a pull cord, a foot lever actuator for the pull cord, comprising:

a) an elongated foot lever mounted pivotally on a fixed support and having a foot pad at the outer end for applying foot pressure to the lever, b) a bight pulley configured for receiving the pull cord thereover, and c) adjustable connecting means interengaging the bight pulley and foot lever at selected positions along the length of the foot lever for moving the bight pulley with the foot lever.

2. The combination of claim 1 wherein the foot lever is mounted pivotally on a fixed support at the end opposite the foot pad and the connecting means comprises a connector securing the bight pulley adjustably along the length of the foot lever.

3. The combination of claim 2 wherein the connector comprises a support member mounting the bight pulley for rotation, and clamp means on the support member configured to engage and be secured adjustably to the foot lever.

4. The combination of claim 2 wherein the connector comprises a cord attachment configured for mounting on the foot lever adjustably along the length of the foot lever and having means thereon for attaching a cord thereto, and a cord interconnecting the cord attaching means and bight pulley.

5. The combination of claim 1 including a second pull cord secured at one end to the bight pulley and at the opposite end to the foot lever.

6. The combination of claim 1 including a second pull cord secured at one end to the bight pulley, a second bight pulley mounted on the foot lever and receiving the second pull cord thereover, and securing means for connecting the opposite end of the second pull cord to the implement.

7. The combination of claim 1 including a second bight pulley mounted on the implement and receiving the pull cord thereover, the end of the pull cord opposite the recoil starter being secured adjustably to the foot lever.

8. The combination of claim 1 wherein the foot lever is mounted pivotally on a fixed support spaced remotely from the implement.

* * * * *